US011371273B2

(12) United States Patent
Casternovia

(10) Patent No.: US 11,371,273 B2
(45) Date of Patent: Jun. 28, 2022

(54) GUARD FOR A LATCH TO PREVENT OPENING

(71) Applicant: Sam Casternovia, Warren, NJ (US)

(72) Inventor: Sam Casternovia, Warren, NJ (US)

( * ) Notice: Subject to any disclaimer, the term of this patent is extended or adjusted under 35 U.S.C. 154(b) by 742 days.

(21) Appl. No.: 16/106,143

(22) Filed: Aug. 21, 2018

(65) Prior Publication Data

US 2020/0063472 A1 Feb. 27, 2020

(51) Int. Cl.

*E05C 17/16* (2006.01)
*E05B 15/12* (2006.01)
*E05C 19/18* (2006.01)

(52) U.S. Cl.

CPC ..... *E05C 17/166* (2013.01); *E05B 17/2023* (2013.01); *E05C 19/184* (2013.01)

(58) Field of Classification Search

CPC .... E05C 17/166; E05C 19/184; E05C 19/182; E05C 19/18; E05C 19/08; E05C 17/00; E05C 17/02; E05C 17/04; E05C 17/047; E05C 17/16; E05C 17/54; E05B 17/2023; E05B 65/0032; E05B 17/20; E05B 17/2088; E05B 63/12; E05B 63/128; E05B 17/2084; E05B 65/0035; E05B 65/48; E05B 65/5284; E05B 65/52; E05B 65/84; E05B 67/38; E05B 67/383; E05B 77/44; Y10T 292/03; Y10T 292/34; Y10T 292/37; Y10T 292/28; Y10T 292/289; Y10T 29/15; Y10T 292/304; Y10T 292/288; Y10T 292/281; Y10T 292/1086; Y10S 292/15

See application file for complete search history.

(56) References Cited

U.S. PATENT DOCUMENTS 622,556 A * 4/1899 Speirs ..... E05C 17/166 292/270
2,508,218 A * 5/1950 Brewer ..... E05B 77/52 292/1
4,062,578 A 12/1977 Chen
4,229,030 A 10/1980 Tarragona Corbella
4,299,361 A * 11/1981 Webb ..... B64C 13/14 244/224

(Continued)

FOREIGN PATENT DOCUMENTS

CN 204112958 U * 1/2015 ..... E05C 17/166
RU 2514485 C1 * 4/2014
WO WO-2009143214 A1 * 11/2009 ..... E05B 67/383

OTHER PUBLICATIONS https://www.youtube.com/watch?v=Wi6a-S6IWMw.

*Primary Examiner* — Kristina R Fulton
*Assistant Examiner* — Tal Saif
(74) *Attorney, Agent, or Firm* — Ezra Sutton

(57) ABSTRACT

A door latch locking guard 30 is provided for maintaining a door in a locked position. A door latch 10 has an existing stationary latch arm 12 and the door jam has an existing swinging arm 14 for engaging the latch arm 12 to lock the door. The present invention provides a protective locking guard 30 having a notch 38 formed therein for placing over the stationary latch arm 12, and the protective locking guard 30 also has a plate 32 for moving the existing swinging arm 14 over the plate 32. A locking clasp 40 is provided for inserting through an opening 36 in plate 32 in order to prevent the door latch 10 from being opened from the opposite side of the door.

3 Claims, 3 Drawing Sheets

(56) References Cited

U.S. PATENT DOCUMENTS 4,386,797 A * 6/1983 Duran, Sr. ..... E05C 19/182 292/292
4,741,564 A * 5/1988 Alford ..... E05C 19/08 292/205
4,900,075 A * 2/1990 Smith ..... E05B 67/383 292/263
4,955,648 A * 9/1990 Miller ..... E05C 19/18 292/258
5,165,263 A * 11/1992 Perron ..... F16K 35/06 70/177
5,409,276 A * 4/1995 Engasser ..... E05C 19/184 292/281
5,547,236 A * 8/1996 Gregory ..... E05C 19/182 292/148
D479,792 S * 9/2003 Winocoor ..... E05C 19/182 D8/331
D479,975 S * 9/2003 Winocoor ..... D8/331
7,905,525 B2 3/2011 Badia
8,899,639 B2 * 12/2014 Ploskunak ..... E05C 19/184 292/288
10,094,154 B2 * 10/2018 Ploskunak ..... E05C 19/184
2005/0052035 A1 3/2005 Yamashita
2006/0043739 A1 * 3/2006 Gogel ..... E05C 19/184 292/148
2008/0217494 A1 * 9/2008 Simpson ..... E06B 11/08 248/205.1
2010/0156121 A1 * 6/2010 Badia ..... E05B 17/007 292/216
2014/0327251 A1 * 11/2014 Brinton ..... E05C 17/166 292/277
2015/0097381 A1 4/2015 Hwang
2016/0362911 A1 * 12/2016 Sussman ..... E05B 17/0041
2017/0044806 A1 * 2/2017 Stansell ..... E05B 17/2003
2018/0163445 A1 * 6/2018 Kingsbury ..... E05C 17/166
2019/0071903 A1 * 3/2019 Thomas ..... E05C 17/166
2020/0011099 A1 * 1/2020 Harrelson ..... E05B 55/12

* cited by examiner

GUARD FOR A LATCH TO PREVENT OPENING

FIELD OF THE INVENTION

This invention relates to a locking guard that is placed on an existing stationary door latch arm 12 to prevent the door latch from being opened by a person on the other side of the door.

BACKGROUND OF THE INVENTION

Door latches are typically used to lock a door, and also allows the door to be partially opened without opening the latch. The typical latch includes a fixed latch arm 12 mounted on the door, and a swinging arm 14 which is mounted next to the door and is moved to engage the latch arm 12 to lock the door.

The problem with such door latches is that they are not secure, since devices have been developed that can be slid through the door crack to unlock the latch from outside the door.

The present invention has been developed to solve this problem, by preventing someone outside the door from inserting a device to open the door latch.

DESCRIPTION OF THE PRIOR ART

There are a number of prior art patents that provide improved door latches, but they have not solved the problem.

U.S. Pat. No. 7,905,525 shows a U-shaped latch cover. U.S. Pat. No. 4,062,578 shows an enlarged ball 23 to prevent the latch from being completely opened. U.S. Published Patent Application No. 2015/0097381 discloses a ball locking member 37 for a door latch. U.S. Pat. No. 4,229,030 discloses a safety door fastening device to retain and limit the angle of openings.

U.S. Patent Application Publication No. 2005/0052035 to Chikara Yamashita discloses a door security latch in which the range of motion of a secured door is variable depending on the degree to which the latch is engaged. Like most prior art latches, Yamashita discloses an arm with a substantially spherical member is mounted to the inside surface of a door such that the arm extends beyond the free edge of the door. A pivotable first yoke mounted to the door frame engages the arm and substantially spherical member such that as the arm travels along the first yoke, the substantially spherical member constrains the arm within the first yoke, limiting the doors swing to the length of the first yoke. A second yoke is also provided which engages the substantially spherical member more closely, limiting the swing of the door to a fraction of an inch. However, the '035 patent application to Yamashita does not disclose a locking pin for inserting through an opening in a locking guard and a plate for passing through the swinging arm.

Thus, the prior art patents do not disclose the present invention.

Objects of the Invention

It is an object of the present invention to provide a locking guard which is placed over a door latch to make it secure, so that the door latch cannot be unlatched from outside the door.

It is another object of the present invention to provide a locking guard having a notch which is placed over the door latch to make it secure, so that the door latch cannot be unlatched from outside the door.

It is another object of the present invention to provide a locking guard having a plate for passing through the swinging arm, wherein the plate receives a locking clasp 40 to prevent the door latch from being opened from the other side of the door.

Another object of the present invention is to provide a locking guard which is inexpensive and easy to install, and easy to remove from the door latch.

Another object of the present invention is to provide a locking guard that allows the existing door lock to open partially as designed to view outside the door and still be secure.

SUMMARY OF THE INVENTION

A door latch locking guard 30 is provided for maintaining a door in a locked position. A door latch 10 has an existing stationary latch arm 12 and the door jamb has an existing swinging arm 14 for engaging the latch arm 12 to lock the door. The present invention provides a protective locking guard 30 having a notch 38 formed therein for placing over the stationary latch arm 12, and the protective locking guard 30 also has a plate 32 for moving the existing swinging arm 14 over the plate 32. A locking clasp 40 is provided for inserting through an opening 36 in plate 32 in order to prevent the door latch 10 from being opened from the opposite side of the door.

DETAILED DESCRIPTION OF THE FIRST EMBODIMENT

Figure 1:
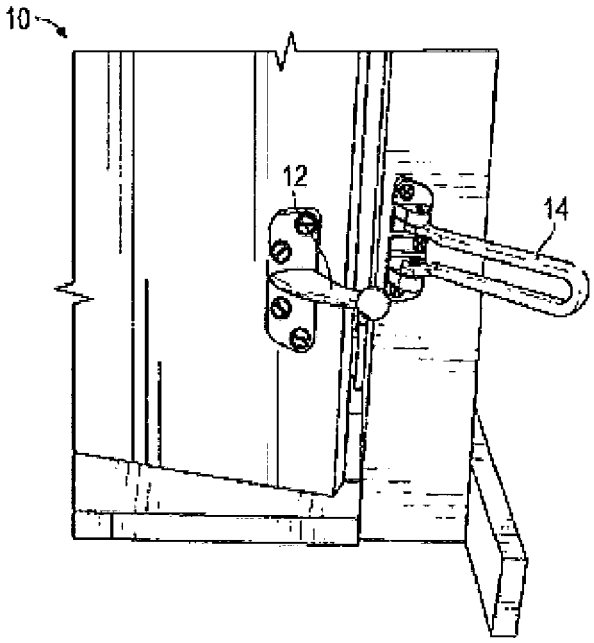
FIG. 1 (PRIOR ART)
FIG. 1 shows a typical door latch and swinging arm without the locking guard of the present invention installed on the door latch.
Figure 2:
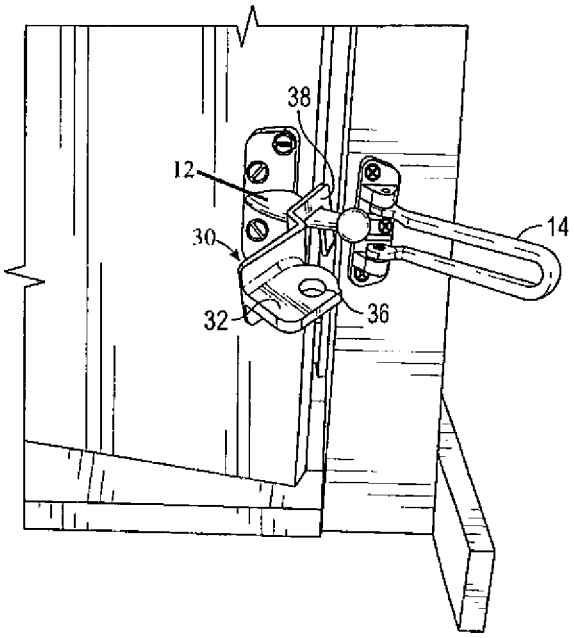
FIG. 2 shows the locking guard 30, including the plate 32 and notch 38.
Figure 3:
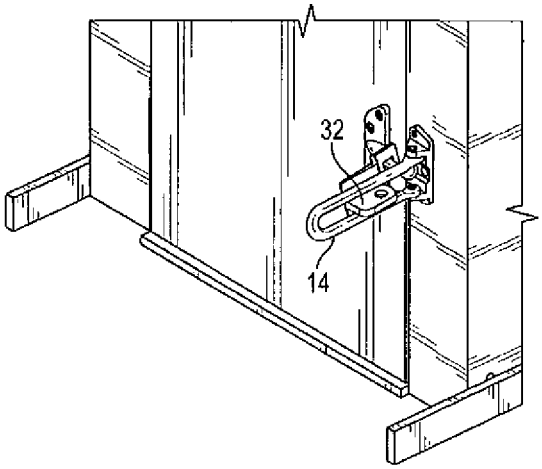
FIG. 3 shows the locking guard 30 in a partially unlocked position.
Figure 4:
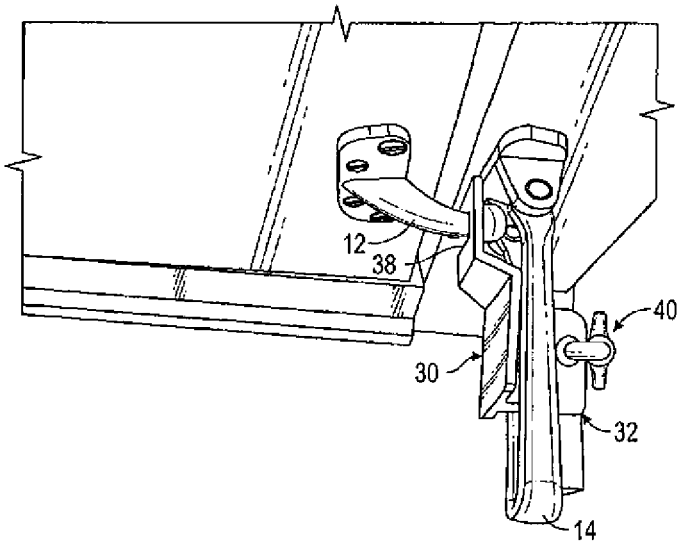
FIG. 4 shows the locking guard 30 in a fully locked position.
Figure 5:
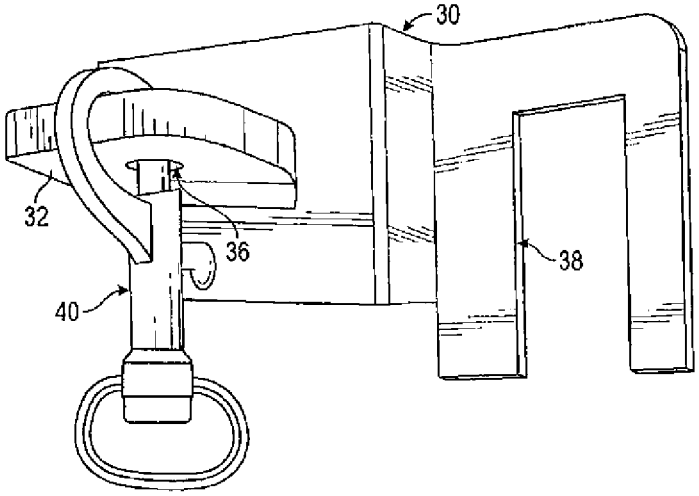
FIG. 5 shows the locking guard 30 in a fully locked position with the locking clasp 40 inserted through the plate 36.

As shown in FIGS. 2 to 4, the present invention provides a protective locking guard 30, which includes a flat horizontal plate 32 and also includes a notch 38 for placing over and engaging the latch arm 12. Specifically, the locking guard 30 includes an elongated vertical stepped plate for releasably securing the locking guard 30 to the existing stationary latch arm 12 and to the existing swinging arm 14. As shown, in FIGS. 2 to 5, the locking guard 30 is completely portable and can be secured to typical door latch security devices 10 without the need for mounting the locking guard using any additional fasteners, e.g., threaded fasteners. The locking guard 30 has a step-up portion at one end and a step-down portion at the other end, wherein the vertical height of the step-down portion can be more than the height of the step-up portion. Also, the step-up portion and the step-down portion are preferably positioned at an angle of greater than 90 degrees with respect to each other. More specifically, the step-down portion has a lower edge with a vertical notch 38 formed therein for releasably securing the step-down portion of the door latch locking guard 30 over the stationary latch arm. As best shown in FIGS. 4 and 5, the step-up portion has a flat horizontal plate 32. The top and bottom planar surfaces of the flat horizontal plate are preferably positioned perpendicular to the vertical notch 38 of the step-down portion. As shown in FIGS. 3 and 4, the horizontal plate 32 passes through the spaced apart horizontal bars of the swinging arm 14 to lock the latch in place. Thus, the horizontal plate 32 removably engages the existing swinging arm 14 such that the horizontal plate 32 travels along the existing swinging arm 14. The flat horizontal plate 32 includes a hole 36 for removably receiving therethrough a locking clasp 40 to hold the locking guard 30 in place and for preventing the door latch 10 from being opened from an opposite side of the door. Accordingly, as shown in FIGS. 2 through 4, when the door latch locking guard 30 is secured to the stationary latch arm 12 and to the existing swinging arm 14, the horizontal plate 32 of the locking guard 30 travels along and within the horizontal bars of the swinging arm 14, while the stationary latch arm 12 travels parallel to the horizontal bars of the swinging arm 14. As a result, the door is permitted to be partially opened while preventing the door from completely opening.

As a result, the locking guard 30 prevents the door latch 10 from being opened from the other side of the door, while still allowing the latch arm 12 to travel along the swinging arm 14 for partial opening of the door while securing it from opening.

OPERATION OF THE INVENTION

In operation, the door is latched with latch arm 12 and swinging arm 14. To install protective locking guard 30, the door is unlatched and the door is moved to the closed position. Then, the notch 38 is placed over the latch arm 12. Next, the horizontal plate 32 is moved between the horizontal bars of swinging arm 14 to lock the latch arm 12 in place. Next, the locking clasp 40 is inserted through the opening 36 to hold the locking guard 30 in place.

To release the locking guard 30 of the present invention, the locking clasp 40 is removed from opening 36. Then the horizontal plate 32 is removed from between the horizontal bars of swinging arm 14. Then, notch 38 is removed from latch arm 12, and the door is unlocked and opens.

As a result, the locking guard 30 prevents the door latch from being opened from the other side of the door. However, when engaged, it still allows the latch arm 12 to travel along the swing arm 14 for partial opening of the door while securing it from opening.

Advantages of the Present Invention

It is an advantage of the present invention is to provide a locking guard having a notch which is placed over the door latch to make it secure, so that the door latch cannot be unlatched from outside the door.

Another advantage of the present invention is to provide a locking guard having a plate for passing through the swinging arm, wherein the plate receives a locking clasp to prevent the door latch from being opened from the other side of the door.

Another advantage of the present invention is to provide a locking guard which is inexpensive and easy to install, and easy to remove from the door latch.

Another advantage of the present invention is to provide a locking guard that allows the existing door lock to open partially as designed to view outside the door and still be secure.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A portable door latch locking guard (30) releasably secured to for a door having a door latch (10) having an existing stationary latch arm (12) in the form of a shaft with a ball at its distal end, and a door jamb having an existing swinging arm (14) with horizontal bars that are spaced apart substantially the entire length of said existing swinging arm (14) and that form a U-shaped opening for engaging the latch arm (12) to lock the door, while still allowing the latch arm (12) to travel along the swinging arm (14) for partial opening of the door while securing the door from being moved to a fully open position, said door latch locking guard (30) comprising:

a) an elongated vertical stepped plate for releasably securing to said existing stationary latch arm (12) and to said existing swinging arm (14), having a step-up portion at one end and a step-down portion at the other end, wherein the vertical height of the step-down portion being more than the height of the step-up portion, and wherein said step-up portion and said step down portion are positioned at an angle of greater than 90 degrees with respect to each other;

b) said step-down portion having a lower edge with a vertical notch (38) formed therein for releasably securing said step-down portion of said door latch locking guard (30) over said stationary latch arm (12);

c) said step-up portion having a flat horizontal plate (32), wherein the top and bottom planar surfaces of said flat horizontal plate are positioned perpendicular to said vertical notch of said step-down portion, and wherein said horizontal plate (32) removably engages said existing swinging arm (14) such that said horizontal plate (32) travels along said existing swinging arm (14);

d) said flat horizontal plate (32) having an opening (36) for removably receiving a locking clasp (40) for preventing said door latch (10) from being opened from an opposite side of the door; and e) wherein when said door latch locking guard (30) is secured to said stationary latch arm (12) and to said existing swinging arm (14), said horizontal plate (32) of said locking guard (30) travels along and within said horizontal bars of said swinging arm (14), while said stationary latch arm (12) travels parallel to said horizontal bars of said swinging arm (14) for permitting said door to be partially opened while preventing said door from completely opening.

2. A portable door latch locking guard (30) releasably secured to a door having a door latch (10) having an existing stationary latch arm (12) in the form of a shaft with a stopper at its distal end, and a door jamb having an existing swinging arm (14) with horizontal bars that are spaced apart substantially the entire length of said existing swinging arm (14) and that form a U-shaped opening for engaging the latch arm (12) to lock the door for partial opening of the door while securing the door from being moved to a fully open position, said door latch locking guard (30) comprising:

a) an elongated vertical stepped plate for releasably securing to said existing stationary latch arm (12) and to said existing swinging arm (14), having a step-up portion at one end and a step-down portion at the other end and wherein said step-up portion and said step-down portion are positioned at an angle of greater than 90 degrees with respect to each other;

b) said step-down portion having a lower edge with a vertical notch (38) for releasably securing said step-down portion of said door latch locking guard (30) over said stationary latch arm (12);

c) said step-up portion having a flat horizontal plate (32), wherein the top and bottom planar surfaces of said flat horizontal plate are positioned perpendicular to said vertical notch of said step-down portion. and wherein said horizontal plate (32) removably engages said existing swinging arm (14) such that said horizontal plate (32) travels along said swinging arm (14);

d) said horizontal plate (32) having an opening (36) for removably receiving a locking clasp (40) for preventing said door latch (10) from being opened from an opposite side of the door; and e) wherein when said door latch locking guard (30) is secured to said stationary latch arm (12) and to said existing swinging arm (14), said horizontal plate (32) of said locking guard (30) travels along and within said horizontal bars of said swinging arm (14), while said stationary latch arm (12) travels parallel to said horizontal bars of said swinging arm (14) for permitting said door to be partially opened while preventing said door from completely opening.

3. A portable door latch locking guard (30) in accordance with claim 2, wherein said existing stationary latch arm (12) has a stopper at its distal end in the shape of a ball.

* * * * *